US005133402A

United States Patent [19]

Ross

[11] Patent Number: 5,133,402

[45] Date of Patent: Jul. 28, 1992

[54] INDUCTION HEATING OF ENDLESS BELTS IN A CONTINUOUS CASTER

[75] Inventor: Nicholas V. Ross, Youngstown, Ohio

[73] Assignee: Ajax Magnethermic Corporation, Warren, Ohio

[21] Appl. No.: 612,428

[22] Filed: Nov. 9, 1990

[51] Int. Cl.[5] ..... B22D 11/06

[52] U.S. Cl. ..... 164/431; 164/481; 164/507

[58] Field of Search ..... 164/431, 432, 481, 483, 164/471, 493, 507, 513

[56] References Cited

U.S. PATENT DOCUMENTS 4,082,101 4/1978 Hazelett et al. ..... 164/432
4,905,753 3/1990 Shio et al. ..... 164/431

FOREIGN PATENT DOCUMENTS 176448 8/1986 Japan ..... 164/481
199556 9/1986 Japan ..... 164/431
171253 7/1988 Japan ..... 164/432
104449 4/1989 Japan ..... 164/432
241357 9/1989 Japan ..... 164/431
1224148 9/1989 Japan ..... 164/481

*Primary Examiner*—Richard K. Seidel
*Attorney, Agent, or Firm*—Fay, Sharpe, Beall, Fagan, Minnich & McKee

[57] ABSTRACT

An induction heating system is applied to a continuous molten metal casting apparatus having two endless flexible casting belts. The belts are arranged such that front surfaces of each belt faces the other belt and a pair of dam blocks arranged at the edges of one of the belts along with the belts themselves form a casting region. Molten metal is delivered to the casting region to form rectangular sheets of cast metal. Inductive heaters preheat the endless belts prior to the belts entry to the casting region. This preheating allows for continuous smooth casting.

9 Claims, 5 Drawing Sheets

INDUCTION HEATING OF ENDLESS BELTS IN A CONTINUOUS CASTER

BACKGROUND OF THE INVENTION

This invention pertains to the art of continuous casting and more particularly to the inductive heating of endless flexible casting belts of a continuous caster.

The invention is particularly applicable to inductive heaters used to preheat the endless belts of a continuous caster which casts molten metal and will be described with particular reference thereto. However, it will be appreciated that the invention has broader applications and may be advantageously employed in other environments and applications.

In a device for continuously casting molten metal, it is known that at least two endless flexible belts constructed of a durable material, such as carbon steel, are mounted on sets of pulleys such that the front surface of the two belts are in a facing relationship. It is further known that a pair of dam blocks can be located at the outer edges of at least one of the endless belts front surfaces. The dam blocks and the endless belts are arranged to form a casting region. Molten metal is delivered into the casting region such that the molten metal is cast into metal of varying width and gauge depending upon dimensions of the casting region. The casting region consists of a casting zone where metal is received in a molten form, and a cooling zone where the metal is caused to solidify.

Additionally, it is further known that the introduction of heat to the endless flexible casting belts causes the belts to expand across their width. When this heating of the belts occurs due to the belts coming into contact with the molten metal, the temperature that is applied to the belts is unregulated and uneven. This unregulated application of heat causes the belts to expand in an uneven nonregulated manner and results in distortions of the metal being cast. In order to eliminate the undesirable effects of this unregulated heating, methods of transferring heat to the belts prior to the belts entering the casting region have been developed. This preheating of the belts will produce a more uniformed casting of the metal by the elimination of belt distortion.

Various types of continuous casting devices and methods employing preheating of belts have been suggested and employed in the continuous casting industry, with varying degrees of success. For example, Hazelett et al. U.S. Pat. No. 3,937,270 employs infra red heaters directed at close range towards the casting surfaces of the belts. This reference also employs heating by means of hot fluid, such as steam, with the hot fluid being directed into deep grooves in the nip roll or pulleys beneath rear surfaces of the casting belts. These methods are applied to twin belt casting machines whether the molten metal is applied by open pool, closed pool or injection feeding.

Steam has also been employed in Hazelett, et al. U.S. Pat. No. 537,243 and UK patent application GB 2,085,779 A to preheat the endless casting belts. These references disclose casting machines which include an apparatus for preheating the casting belt with steam closely ahead of the entrance to the casting zone by providing wrap around steam feed tubes having steam outlet nozzles. These tubes are positioned in very deep circumferential groves in the input pulley or nip pulley which move the casting belt into the input end of the casting zone. These circumferential groves of the input or nip pulley also house wrap around liquid coolant feed tubes for cooling the casting belt in the cooling zone.

However, when using the known apparatuses and methods of preheating the casting belts in a continuous caster, various problems exist. Initially, in order for the preheating of belts to be effective certain temperatures need to be obtained. When using the steam method various practical concerns limit the temperature to which the steam can be raised. In existing casting systems, this temperature has been in the range of 180° to 200° F. Thus for certain metals which require the belts to be preheated to higher temperatures, steam is not a practical solution.

When using infra red to preheat the belts to the required temperature the belts need to be preheated over extended areas of the belts surfaces for considerable periods of times. Therefore, the heating units required to heat the belts to the desirable levels take up considerable physical space within the casting machine. Since the casting machine is a very compact device, especially at the location of the input of the molten metal, the requirements for the significant volume of infra red heaters cause engineering and construction problems in order to provide available space.

Additionally, both with the steam and the infra red heaters an inconsistency in the transfer of heat to the belts exist. For instance, when employing an infra red heating system individual heating units are employed thus decreasing the certainty that a controlled transfer of heat to the belts is occurring. At the same time, if a flame infra red heating device is used, imprecise fuel flow rates can cause flames to issue from the burner housing and burn the endless belts damaging their surface.

The present invention contemplates a new and improved apparatus and method which overcomes all of the above referred to problems and others. The device provides a new continuous casting device with a heating system for preheating flexible endless casting belts which is simple in design, limited in the physical space required to implement it, economical to manufacturer, adaptable to a plurality of dimensional characteristics, is rugged and reliable in its operation, and which provides an improved uniform transference of heat in a substantially instantaneous manner over a limited physical area such that uniform expansion occurs which in turn results in a better uniformed casting of metal.

SUMMARY OF THE INVENTION

In accordance with the present invention there is provided an apparatus for continuously casting molten metal compromising pulleys with first and second endless casting belts mounted thereon. Each of the endless belts are arranged such that front surfaces of the endless belts face the other endless belt's front surface. Further included are a pair of dam blocks located on opposite outer edges of the front surface of one of the first or second endless belts. The pair of dam blocks are located such that the front surfaces of the first and second endless belts and the pair of dam blocks, define a casting region. The casting region is comprised of a casting zone where metal is provided in a molten form, and a cooling zone for solidifying the metal. A device for providing molten metal is positioned to deliver the molten metal at the beginning of the casting zone. A motor or other force rotates the pulleys which in turn move the mounted first and second endless belts and the pair of dam blocks such that the metal provided to the casting region is continuously progressed. First and second induction heaters for inductively heating the first and second endless belts, prior to introduction of the molten metal into the casting region, are located in close proximity to the endless belts around a portion of the circumference of selected pulleys.

Further in accordance with the invention, an induction heater system is provided for use in a continuous molten metal casting apparatus. The induction heater system includes a first induction heater in operative association with a front surface of a first endless belt. The first induction heater includes a hollow conductor having first and second legs for carrying current on its exterior surface. A current connector passes current from a current source to the conductor. A second inductive heater is also placed in operative association with a front surface of a second endless belt. The second inductive heater includes identical construction as that described in relationship to the first inductive heater. The first and second inductive heaters are arranged to inductively heat the front surfaces of the first and second endless belts prior to the belts receiving molten metal. Inductive heat is generated in the first and second endless belts by positioning the belts in close proximity to the inductive heaters such that the endless belts act as loads for the inductive heaters.

In accordance with another aspect of the present invention, a method for continuously casting molten metal is provided. A first endless belt mounted on at least two pulleys is rotated. A second endless belt mounted on at least two pulleys is also rotated. The belts are mounted such that a front surface of the second endless belt is facing a front surface of the first endless belt. A pair of dam blocks arranged in operative association with opposite outer edges of the front surface of at least one of the first and second endless belts are rotated such that rotation of the first and second belts and the dam blocks create a defined casting region. The casting region is arranged to include a casting zone for receiving molten metal and a cooling zone for solidifying the metal. The molten metal is provided to the front portion of the casting zone. The first and second endless belts are inductively heated with first and second inductive heating means by rotating the belts in close proximity of the inductive heaters. This occurs prior to molten metal being provided to the casting zone, whereby the inductive heat causes the belts to expand in a controlled manner prior to receiving the molten metal.

One benefit obtained by the use of the present invention is the ability to provide instantaneous heat of a desired temperature in an independent manner to each of the moving belts as soon as the induction heaters are energized.

Another benefit from the present invention is the ability to transfer highly uniform heat within a limited area. Thus, the present invention is able to induce highly concentrated amounts of energy into the belt within a limited physical space to provide stable casting regions for a more uniform casting.

Yet another benefit of the present invention is the efficient use of space due to the ability to transfer heat energy to the belt in a small area. This allows for less physical space to be taken up by heating elements required to heat the belts to desired temperature levels.

A further benefit is through the adjustment of the rotational speed of the belts and the adjustment in the amount of heat produced by the induction heaters, it is possible to easily adjust the point within the casting region at which solidification of the molten metal occurs.

Still further advantages of the present invention will become apparent to those of ordinary skill in the art upon reading and understanding the detailed description of the preferred embodiment.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 1:
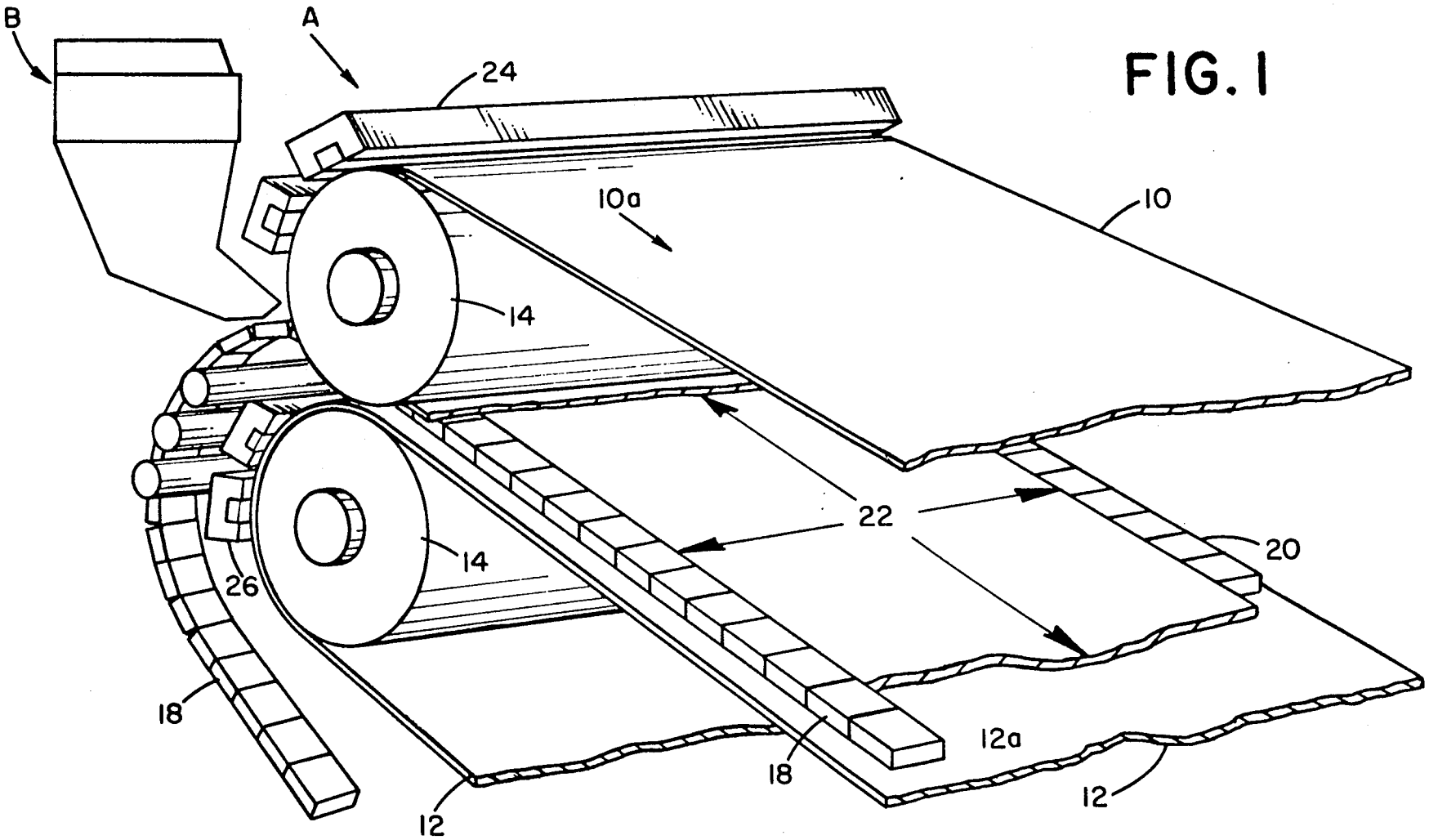
FIG. 1 is an illustration of an embodiment for the subject invention.

Referring now to the drawings wherein the showings are for purposes illustrating the preferred embodiments of the invention only and not for purposes of limiting the same.

Figure 2:
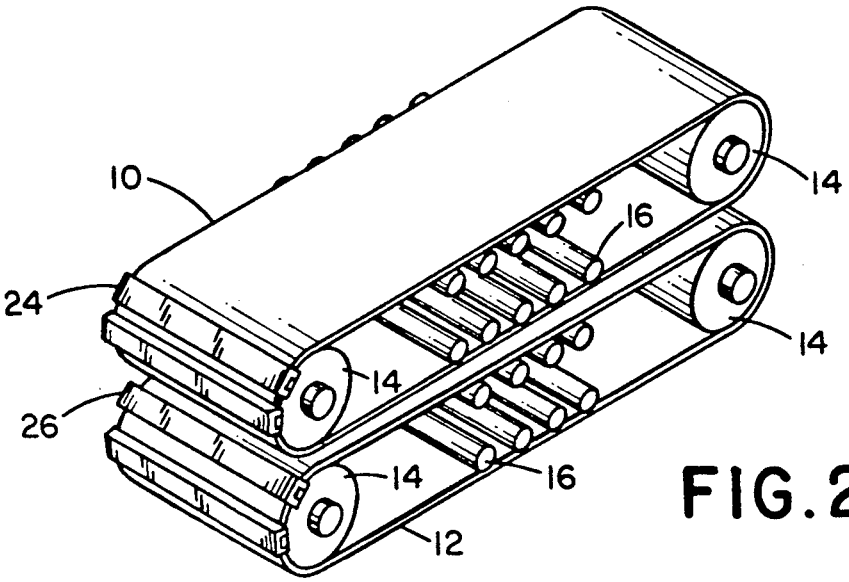
FIG. 2 is an illustration similar to FIG. 1 showing both ends of the endless belt arrangement.

FIG. 1 shows a continuous casting apparatus A for the casting of molten metal. A delivery system B delivers molten metal to the continuous caster A. The continuous caster A includes a first endless flexible belt 10 and a corresponding second endless flexible belt 12. In one embodiment these belts are constructed of carbon steel. The belts are mounted on pulleys 14. FIG. 2 shows the manner in which the belts 10 and 12 are mounted on pulleys 14 in an endless conveyor type system. In particular belts 10 and 12 are each looped around and mounted on at least two pulleys 14 the second set of pulleys 14 are shown in FIG. 2. As also shown in FIG. 2 additional supporting pulleys or rollers 16 are disbursed within the continuous caster to further support belts 10 and 12.

Returning attention to FIG. 1, a pair of dam blocks 18 and 20 are arranged to travel along the outer edges of the endless belt 12. The height of the dam blocks are a determining factor in establishing the thickness of the metal strip being cast.

Front surfaces 10*a* and 12*a* of endless belts 10 and 12 are arranged such that they face one another upon passing the pulleys 14 shown in FIG. 1. The bounds of the casting region 22 are set by the spaced relationship of belts 10 and 12 along with dam blocks 18 and 20.

A motor, not shown, causes pulleys 14 to rotate which in turn moves endless belts 10 and 12 along with dam blocks 18 and 20. This allows continual movement of the metal being cast through the casting region 22 and operation of the continuous caster A. As the belts rotate around pulleys 14 they are, for a portion of that rotation, heated by inductive heaters 24 and 26. Heaters 24 and 26 are of a "U" shaped configuration as is more clearly shown in FIG. 5.

Figure 3A:
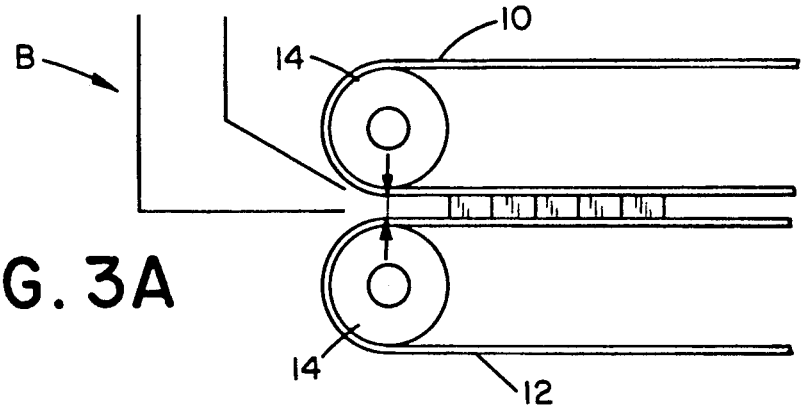
FIGS. 3*a* and 3*b* are partial side views of the preferred embodiment illustrated in FIG. 1.
Figure 3B:
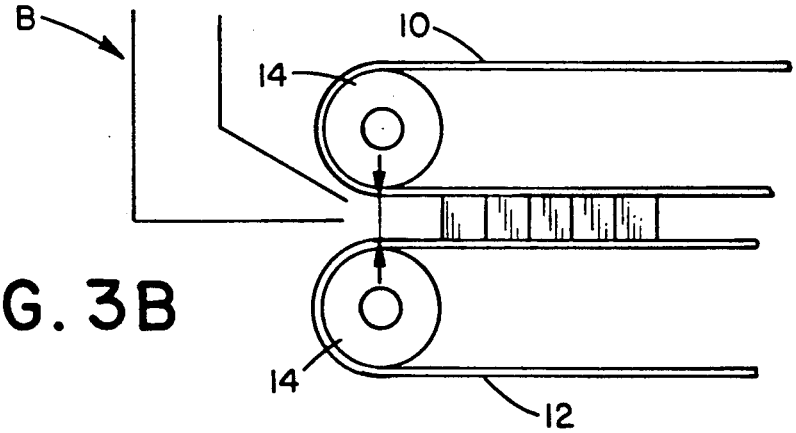

The parameters of the casting region 22 include the pair of dam blocks 18 and 20 for the width of the cast. The space between the first endless belt 10 and second endless belt 12 and the height of the dam blocks 18, 20 provide the gauge or thickness of the metal to be formed. As shown in FIGS. 3*a* and 3*b*, it is possible to adjust the gauge or depth of continuous cast metal by adjusting the space between the pulleys 14 on which the belts are mounted. This adjustment allows dam blocks of varying heights to be employed. These changes allow a single machine to cast metal of varying gauges.

As the molten metal is received into casting region 22 a cooling fluid such as water, not shown, is delivered to the back sides of endless belts 10 and 12. The water draws the heat away from the endless belts lowering the temperature of the metal causing molten metal to solidify.

Dependent upon the melting point of the metal being cast, the gage of the metal, and the speed of the belts, the power applied to the induction heaters 24 and 26 can be varied.

For example, should the belts be operating at a fast speed more power can be delivered to the induction heaters 24 and 26 raising the amount of heat transferred to the endless belts. Thus, even though the belts are rotating faster and will therefore be exposed to the heaters for a shorter time, a constant temperature can nevertheless be induced into the belts.

The adjustability of both the speed of the belts and the temperature produced by the inductive heaters 24, 26 also provides the benefit of allowing a simple manner in which to adjust the point at which solidification of the molten metal occurs in the casting region. In particular, by adjusting the speed of rotation and temperature, the position where solidification takes place can be moved either closer or farther away from the pulleys 14 of FIG. 1. Depending upon the type of metal being cast location of this solidification point can increase the quality of the cast metal and the efficiency of the system.

The above are just a couple of examples of reasons to vary the power transferred to the heaters 24 and 26. Numerous other factors, dependent on independent situations, would require the varying of the power to the induction heaters.

Employing induction heating to pre-heat the belts results in consistent, highly controllable temperatures. In some instances it is desirable to elevate the temperature at the edges of the belts to a higher degree then the center of the belts or visa versa. Through the use of the induction heating this can be accomplished.

Inductive heaters 24 and 26 in this embodiment are of a transverse flux inductor assembly type and are arranged in close proximity to the pulleys located at the entrance of the casting region 22 and in close relationship to belts 10 and 12 respectively. Inductive heaters 24 and 26 are employed to preheat belts 10 and 12 prior to the belts entering the casting region 22. When the belts come into contact with high temperatures they display the characteristics of expansion. If the belts are not preheated to a suitable temperature prior to coming into contact with the molten metal the belts 10 and 12 will at that time expand in an unknown manner.

Figure 4A:
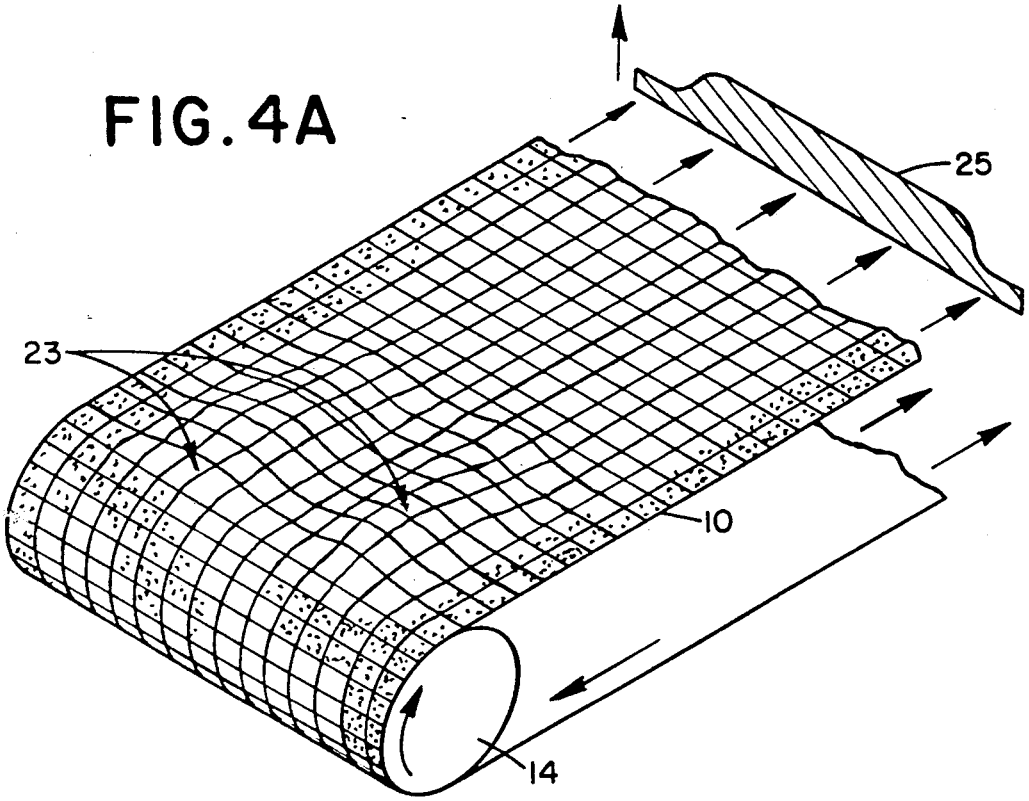
FIGS. 4*a* and 4*b* are schematic illustrations of belts and their temperature profile, which has not been preheated and which has been pre-heated respectively.

FIG. 4*a* shows a typical manner in which such expansion can occur when a belt has not been properly preheated.

Figure 4B:
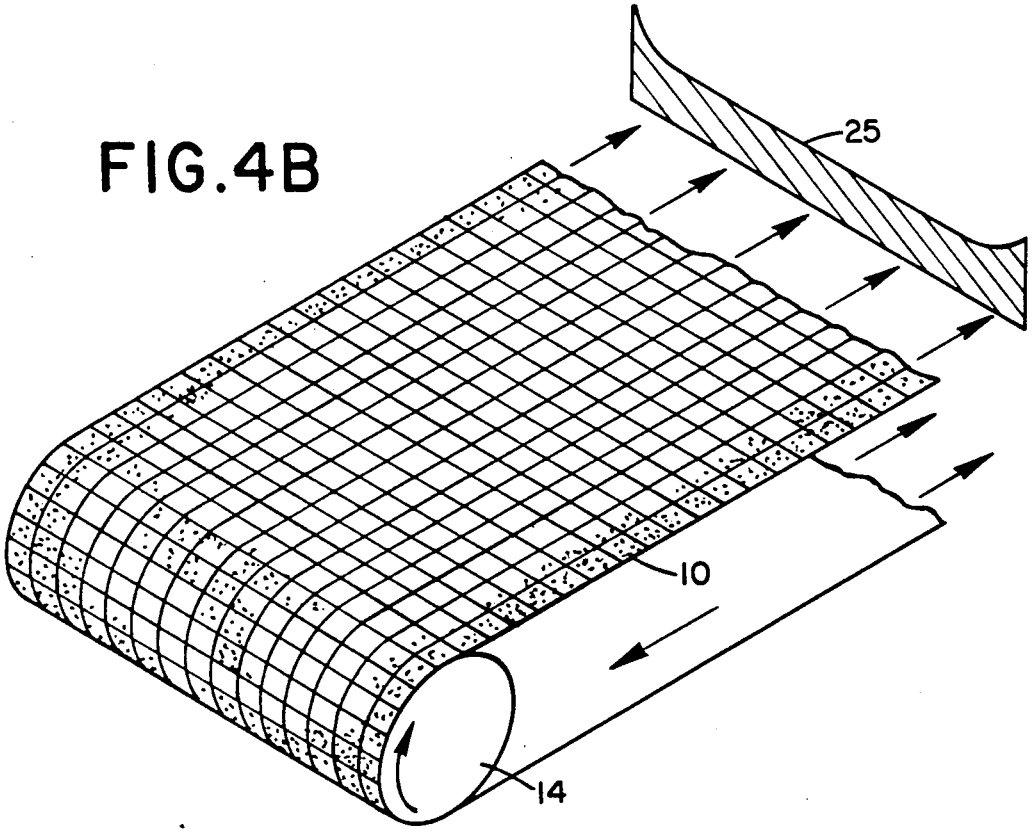

In particular FIG. 4*a* depicts a situation where transverse buckling 23 occurs due to improper heating of the outer edges of belt 10. As depicted by the transverse belt temperature profile 25, the outer edges of belt 10 are not raised to a temperature equivalent to that of the interior portion of the belt 10. FIG. 4*b* is an example of a belt which has been properly preheated. In particular, as depicted by the transverse belt temperature profile 25, the outer edges have been raised to a temperature even greater than that of the remainder of the belt. This method of heating eliminates the transverse buckling problems of FIG. 4*a*.

Figure 5A:
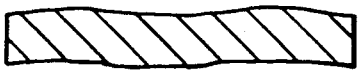
FIGS. 5*a* and 5*b* are cross sectional views of two samples of cast metal.
Figure 5B:
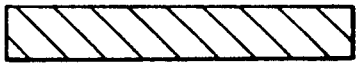

When improper heating of the belts occurs, undesirable affects are obtained in the casting. FIG. 5A shows an example of a possible cross sectional view if the casting belts 10 and 12 were not pre-heated before contact with a molten metal. Due to the expansion at that point in time, necking and transverse buckling results. However as shown in FIG. 5B if the belts are preheated to suitable temperatures they will have already expanded prior to coming into contact with the molten metal resulting in a more uniform cast. In one example for the casting of aluminum which has a melting point of approximately 1300° F. the belts are preheated to 200°–400° F.

Figure 6:
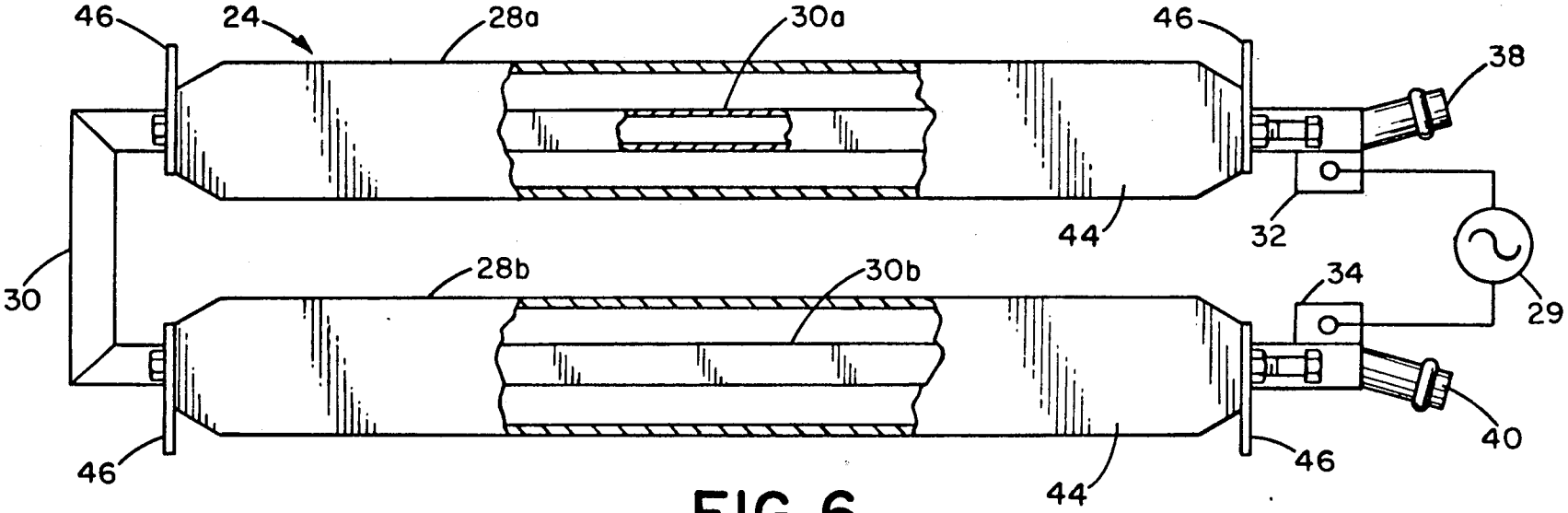
FIG. 6 is a top view of one of the inductor heating devices of the present invention.

FIG. 6 is a top view of inductive heater 24. The discussion concerning inductive heater 24 is applicable to inductive heater 26. The heaters 24, 26 are constructed in the form of a 'U' shaped configuration having two legs 28*a*, 28*b* each of the legs include laminations 44 over selected amount of their lengths. Additionally, when mounting of the heaters occur, both legs 28*a*, 28*b* are placed immediately adjacent the front surfaces of the respective belts 10, 12. The laminations 44 and arrangement of the heaters 24, 26 provide for an increased integrity of the current flowing through the heaters and minimizes the potential of external currents to be formed. These external currents could result in arcing and sparking between the heaters 24, 26 and the pulleys 14.

A coil of inductive heater 24 is compromised of a rectangular conductor 30 preferably of copper. The coil consists of two legs 30*a* and 30*b* formed in a generally U-shaped design. In one typical implementation, the coil is used in a casting system with the following parameters. The belts are comprised of carbon steel with a specific heat ('C') of 0.15 KWSEC/#F° (wherein KWSEC is Kilowatt seconds; # is the heated portion of the belts; and F° is the temperature in Fahrenheit). The density ('S') of the carbon steel belts is 0.284 $\#/IN^3$ (wherein $\#/IN^3$ is the density of the belts). The thickness ('A')of the belts is 0.050" and the width ('W') of the belts is 24". The speed ('V') at which the belts are rotating is 24 FT/MIN. The width ('B') of metal to be cast (aluminum) is 12" and the thickness ('THK') of metal to be cast (aluminum) is 0.625" in order to obtain a resulting temperature rise ('Δt') of approximately 70° to 400° F. The coil is arranged to receive a nominal 165 volts, 3,700 amps, 150 kw with a frequency of 3,000 Hz.

It is to be appreciated the above is simply one typical example of how a specific system might function to show that the interrelationship of numerous parameters that are involved in deciding the proper use of a casting system.

An adjustable electric input 29 is connected to the conductor 30 through current connectors 32 and 34. Current supplied by adjustable electric input 30 travels on the exterior of the conductor 30.

In order to reduce the temperature of the conductor coil 30 during operation a liquid, preferably water, is introduced into the interior of the conductor coil 30 through an input 38. The water circulates through the interior of conductor 30 in order to maintain the integrity of the conductor when the temperature of the conductor increases due to its being used as an induction heater. The water exits the two legged conductor 30 through an output 40.

Figure 7:
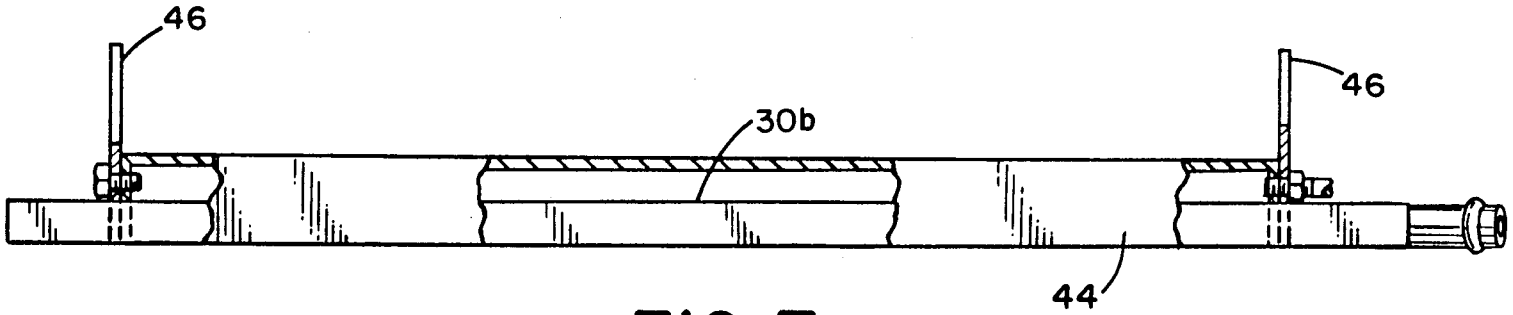
FIG. 7 is a side view showing an outer leg of FIG. 6.

As shown in FIG. 7 brackets 46 are attached to the inductive heater to assist in mounting the heater within the continuous casting apparatus A. In a preferred embodiment of the inductive heater 24, approximately 13 gallons per minute will be introduced into the conductor through the cooling device 40.

By employing inductive heating techniques to heat the endless casting belts 10 and 12, the area in which belts must be heated to desired temperatures is reduced to the width of the inductive heater elements. In the present embodiment that distance is less than 12 inches. Additionally due to minimizing the area required to heat the belts the distances between the heaters and the point at which the belts enter the casting region can be reduced thus assisting in maintaining the heat induced in belts 10 and 12.

Figure 8A:
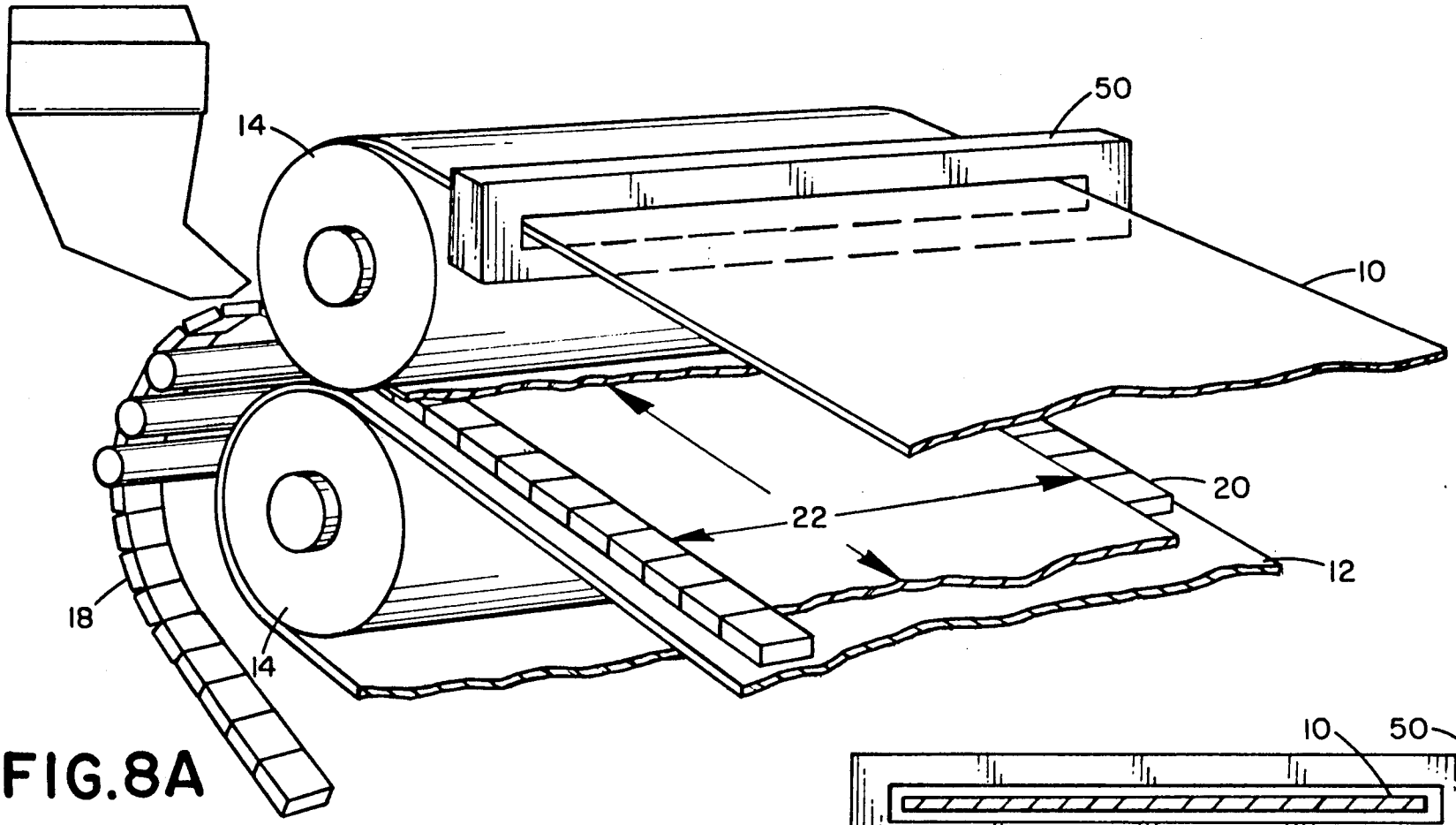
FIG. 8*a* is an illustration of an additional embodiment of the subject invention.
Figure 8B:
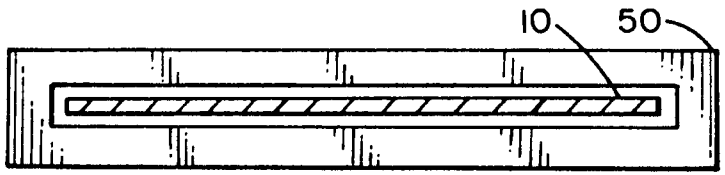
FIG. 8*b* is a front perspective view of FIG. 7*a*.

FIG. 8 is an additional embodiment of the present invention. In this embodiment the transverse flux inductor assembly 24, shown in FIG. 1, is replaced with a solenoid type induction heating coil 50. A second solenoid type induction heating coil, not shown, is also included in this embodiment to replace the inductor assembly 26 of FIG. 1. Similar to the illustration of FIG. 1, heat is generated in the endless belts 10 and 12 when the belts pass through the actuated solenoid inductive heater 50 and the second, not shown, solenoid heater. Therefore, the belts are acting as the load to the heating coil. A frontal perspective view of this embodiment is presented by FIG. 8*b*.

One advantage of the present invention is realized by the economical use of space within the casting system for heating the belts. Inductive heating of the belts is accomplished in a smaller area than previously possible thus allowing for greater ease in designing and building continuous casters of this type. Further, the resulting increased density of the heat to the belts provides improved control and results in the improved casting of the metal.

Another advantage is realized by providing an apparatus which allows a practical manner to elevate the temperature of the endless casting belts to levels of 200° F. and above in an easy efficient manner. Yet another advantage is realized by the quality control for the uniformity of heating applied to the endless belts. This uniformity of heating supplied by the induction heating techniques allows for a uniform expansion of the belts which in turn allows for consistent uniformed casting of molten metal.

The invention has been described with reference to the preferred embodiments. Obviously modifications and alterations will occur to others upon reading and understanding of this specification. It is intended to include all such modifications and alterations in so far as they come within the scope of the appended claims or equivalents thereof.

Having thus described the invention, it is now claimed:

1. An apparatus for continuously casting molten metal comprising:

pulleys;

first and second endless belts mounted on the pulleys, a front surface of the first endless belt facing a front surface of the second endless belt;

a pair of dam blocks located on opposite outer edges of the front surface of at least one of the first and second endless belts, such that the front surfaces of the first and second belts, and the pair of dam blocks define a casting region;

a molten metal providing means for providing molten metal to the casting region;

a motor means for rotating the pulleys which in turn move the mounted first and second endless belts, and the pair of dam blocks; and, first and second induction heating means with laminations applied over selected areas, each heating means located immediately adjacent the surface of the respective belts and solely adjacent the pulleys for inductively heating the first and second endless belts prior to introduction of molten metal into the casting region, the first induction heating means mounted in close association with the first endless belt and the second induction heating means mounted in close association with the second endless belt, whereby the first and second belts are inductively heated during rotation of the belts in close proximity to the first and second induction heating means, thereby expanding the belts prior to receiving the molten metal and thus allowing production of a uniform strip of cast metal.

2. The apparatus of claim 1 wherein the first endless belt is a load for the first induction heating means, and the second endless belt is a load for the second induction heating means, such that upon activating both the induction heating means a desired temperature is instantaneously induced into the first and second endless belts.

3. The apparatus of claim 2 wherein the temperature induced in the first belt by the first induction heating means and the temperature induced in the second belt by the second induction heating means are independently obtainable.

4. The apparatus of claim 2 wherein both of the induction heating means are further constructed such that heat generated is made uniform across a selected width of the belts.

5. The apparatus of claim 2 wherein both the induction heating means include means for adjustably producing a non-uniform generation of heat across a selected width of the belts.

6. The apparatus of claim 2 wherein both the induction heating means include means for heating the outer edges of the belts to a temperature greater than the remaining portion of the belts.

7. The apparatus of claim 1 wherein the endless belts are constructed of an electrically conductive material.

8. The apparatus of claim 1 wherein the first and second inductive heating means comprise a transverse flux inductor assembly.

9. The apparatus of claim 1 wherein the first and second inductive heating means are of a solenoid type induction heating coil.

* * * * *